United States Patent [19]

Yanagisawa et al.

[11] 3,976,907

[45] Aug. 24, 1976

[54] GAS DISCHARGE DISPLAY TUBE WITH BARRIER MEANS FOR PREVENTION OF ION SCATTERING

[75] Inventors: Yuzuru Yanagisawa, Fujisawa; Akio Ohgoshi, Tokyo; Akira Yamanaka, Fuchu; Shoichi Muramoto, Tokyo, all of Japan

[73] Assignee: Sony Corporation, Tokyo, Japan

[22] Filed: May 1, 1974

[21] Appl. No.: 465,753

Related U.S. Application Data

[60] Division of Ser. No. 365,334, June 4, 1973, which is a continuation of Ser. No. 177,990, Sept. 7, 1971, abandoned.

[30] Foreign Application Priority Data

Sept. 11, 1970 Japan ..... 45-80378

[52] U.S. Cl. ..... 313/519; 313/190; 313/220

[51] Int. Cl.[2] ..... H01J 61/30; H01J 61/66

[58] Field of Search ..... 313/517, 519, 220, 204, 313/190

[56] References Cited

UNITED STATES PATENTS

| | | | |
|---|---|---|---|
| 2,686,273 | 8/1954 | Hough et al. | 313/190 |
| 3,418,509 | 12/1968 | Frouws et al. | 313/519 |
| 3,588,571 | 6/1971 | Vemura et al. | 313/519 |
| 3,666,981 | 5/1972 | Lay | 313/190 |
| 3,675,065 | 7/1972 | Warne | 313/519 |
| 3,780,341 | 12/1973 | Holz et al. | 315/169 TV |
| 3,868,535 | 2/1975 | Kupsky | 313/190 X |

FOREIGN PATENTS OR APPLICATIONS

| | | | |
|---|---|---|---|
| 24,119 | 11/1968 | Japan | 313/519 |

*Primary Examiner*—Palmer C. Demeo
*Attorney, Agent, or Firm*—Hill, Gross, Simpson, Van Santen, Steadman, Chiara & Simpson

[57] ABSTRACT

An indicator display tube in which indicator electrode units, each consisting of anode and cathode segments, lie in the same plane and in which all of the cathode segments are simultaneously energized and the anode electrodes are energized on a time sequential basis in such a manner that only the indicator electrode unit having its anode electrodes energized will glow at a particular time. The cathode segments of each indicator unit are connected in parallel which substantially reduces the number of leads to the display tube over conventional indicators which require a separate lead for energizing each of the cathode segments. The indicator display tube has means for preventing accidental discharge of adjacent indicator electrode units which would produce erroneous message displays.

6 Claims, 23 Drawing Figures

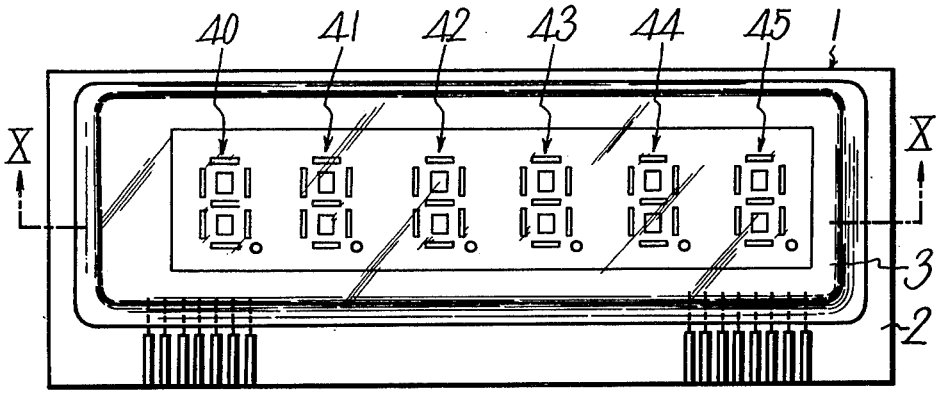
Fig. 1
Fig. 2
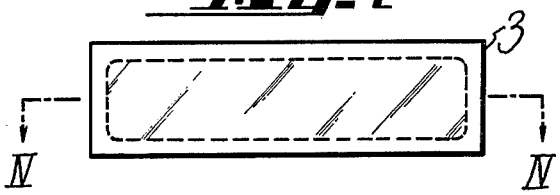
Fig. 3
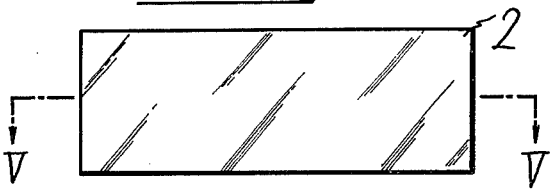
Fig. 4
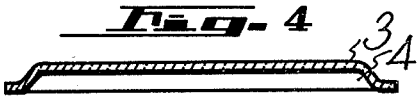
Fig. 5
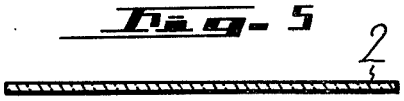

GAS DISCHARGE DISPLAY TUBE WITH BARRIER MEANS FOR PREVENTION OF ION SCATTERING

This is a division of application Ser. No. 365,334 filed June 4, 1973, which, in turn, is a continuation of application Ser. No. 177,990, filed Sept. 7, 1971, and now abandoned.

BACKGROUND OF THE INVENTION

1. Field of the Invention

This invention relates in general to an indicator display tube and, in particular, to a novel indicator display tube and to a method for making it.

2. Description of the Prior Art

Generally, Indicator display tubes, which are of the type including a plurality of indicator units mounted inside a transparent envelope for displaying numerals, symbols, letters or the like, have been used with electronic counters and other various indicating devices. One example of such indicator display tubes is the so-called "Nixie" tube in which an anode and a plurality of cathodes are aligned in a stack one above another and the cathodes are selectively energized to provide a display of a desired numeral or letter. Another type of indicator display tube utilizes cathode segments mounted in a common plane and an anode in the form of a wire screen or mesh mounted in a second plane.

For displaying a number containing a plurality of figures with the Nixie tube, it is necessary to employ the same number of Nixie tubes as that of the figures, which inevitably leads to bulkiness of an indicator display device. Accordingly, the Nixie tube is not suitable for such number display. The indicator display tube with cathodes in a common plane is small and thin but requires the same number of leads as used in Nixie tubes. The large number of leads are difficult to form and to lead out of the envelope and results in complexity in the external wiring.

U.S. Pat. No. 3,588,571 discloses an indicator display tube of the type in which many indicator electrode units, each consisting of an anode and a plurality of cathode segments are formed on an insulating plate with the cathode segments in each unit connected in common to those in the other units and connected to common energizing leads but in which the anodes are connected to separate energizing leads which are led out of the envelope. This indicator display tube has advantages in that the number of the leads required is smaller than that of the prior art tubes. However, such tube is likely to provide an incorrect message display because the indicator units are driven on a time sequential basis and the repeating glow discharge causes the ionizable gas, for example argon or neon which is sealed in the envelope, to produce ions which diffuse toward electrodes of adjacent units which lowers the discharge initiating voltage between anode and cathode segments of the adjacent electrode units and causes them to glow.

SUMMARY OF THE INVENTION

The present invention relates to an indicator display tube which has a number of indicator electrode units with their anode and cathode segments formed in a common plane and includes means provided between adjacent indicator electrode units to prevent accidental discharges. The cathode segments of each electrode unit are electrically interconnected to corresponding ones of the other units and are simultaneously energized. The anodes of each unit are energized on a time-sequential basis in such a manner that a particular electrode unit which has its anode energized provides a display.

Accordingly, one object of this invention is to provide an improved indicator display tube which is provided with many indicator electrode units.

Another object of this invention is to provide an indicator display tube which is adapted to prevent an incorrect message display and which is simple in construction.

A further object of this invention is to provide an indicator display tube which is compact, convenient and has long life.

Still a further object of this invention is to provide an indicator display tube which is easy to manufacture.

Other objects, features and advantages of this invention will become apparent from the following description taken in conjunction with the accompanying drawings.

BRIEF DESCRIPTION OF THE DRAWINGS

FIG. 1 is a plan view schematically illustrating one example of an indicator display tube of this invention;

FIG. 2 is a plan view of a cover plate of the indicator display tube of this invention;

FIG. 3 is a plan view of the glass backing plate of the invention;

FIG. 4 is a sectional view taken on line IV—IV of FIG. 2;

FIG. 5 is a sectional view taken on line V—V of FIG. 3;

DESCRIPTION OF THE PREFERRED EMBODIMENT

Figure 6:
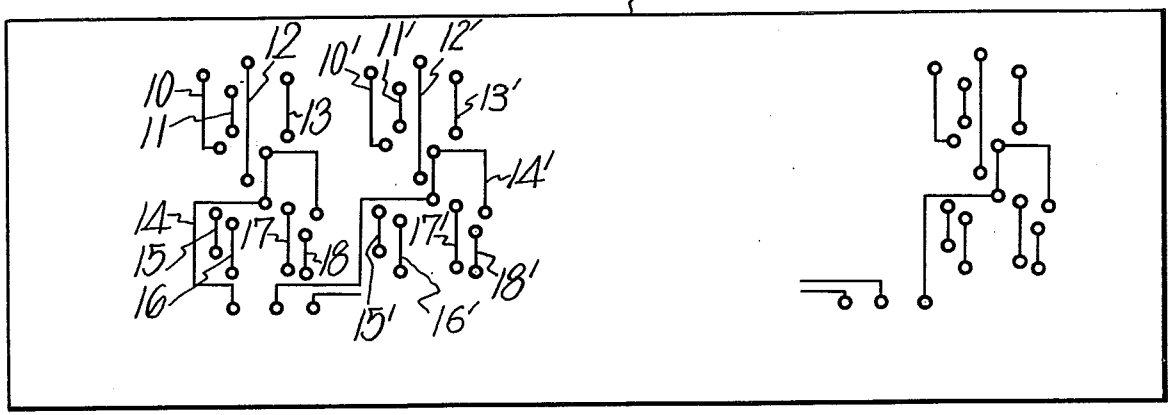
FIG. 6 is a plan view of the backing plate illustrated in FIG. 3 with a plurality of interconnecting leads formed thereon.

In FIG. 1 there is illustrated generally one example of a gaseous glow type indicator display tube 1 produced according to this invention. The indicator display tube 1 is made up of a base plate 2 of an insulating material as, for example, glass. A plurality of indicator units 40, 41, 42, 43, 44, and 45, of the same pattern are formed by printing techniques on the base plate 2 in alignment with one another and a transparent cover plate 3, as of glass, is attached at its periphery in an airtight manner to the base plate 2 and its center is spaced a predetermined distance from the indicator units.

The indicator display tube 1 of the present invention is constructed in the following manner: The insulating base plate 2 such as illustrated in FIG. 3 has the indicator units and the interconnecting leads formed thereon. The transparent cover plate 3 is attached to the base plate 2 after the indicator units are formed. The cover plate 3 is formed with a depression or hollow portion 4 in which the indicator units are received as shown in FIG. 4.

Both of the plates 2 and 3 may be made of glass and generally the base plate 2 is larger in area than the cover plate 3 as may be observed by comparing FIGS. 2 and 3.

FIG. 4 is a sectional view taken on line IV—IV of FIG. 2 and illustrates the depression 4 in the cover plate 3.

FIG. 5 is a sectional view taken on line V—V of FIG. 3.

FIG. 6 is an enlarged plan view of the base plate 2 and illustrates a plurality of interconnecting leads 10 to 18 which are formed on the insulating base plate 2 by suitable thin film techniques such as, for example, by printing. It is to be particularly noted that the interconnecting leads 10 to 18 are grouped so that they will align with indicator units to be formed above a particular group. Thus, the interconnecting leads for the first indicator unit are designated by numerals 10 to 18 and the interconnected leads for the second unit are designated by numerals 10′ to 18′. The interconnecting leads are formed of silver paste which adhers well to the glass base plate 2.

After the interconnecting leads are formed by printed circuit techniques on the base plate 2, the plate and leads are baked to provide suitable bonding.

It is to be realized that the lengths of the interconnecting leads 10 to 18 are such that they will be capable of interconnecting the cathode and anode elements of the indicator units to suitable selecting leads as will become more apparent in the description.

Figure 7:
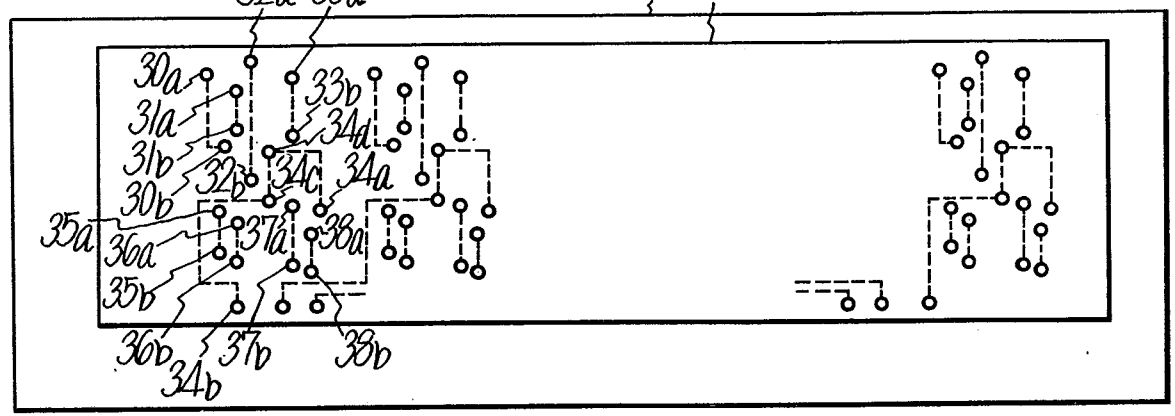
FIG. 7 is a plan view of the backing plate of FIG. 6 with an insulating layer formed over the interconnecting leads.

FIG. 7 is a plan view of the base plate 2 in which a glass insulating layer 20 has been deposited on the base plate 2 so as to cover a substantial portion of the interconnecting leads 10 to 18. The insulating layer 20 may be formed by a glass coating method by applying glass coating by spraying two or three times and then by drying it to provide it with a suitable insulation coating 20 over the interconnecting leads.

windows are formed in the insulating layer 20 at opposite ends at each of the interconnecting leads 10 to 18 so as to allow electrical conducting paths to be formed through the insulating layer 20 to the interconnecting leads 10 to 18. For example, windows 30*a* and 30*b* are formed through the insulating layer 20 at opposite ends of the interconnecting lead 10. Windows 31*a* and 31*b* are formed at opposite ends of the interconnecting lead 11 and additional windows 32*a* and 32*b* through 38*a* and 38*b* are respectively formed at opposite ends of leads 12 to 18. Additional windows intermediate the ends of lead 14 are formed and are designated 34*c* and 34*d*.

It is to be realized, of course, that the windows formed through the layer 20 are formed for each of the indicator units although they are only particularly numbered in FIG. 7 for the first indicator unit.

Figure 8:
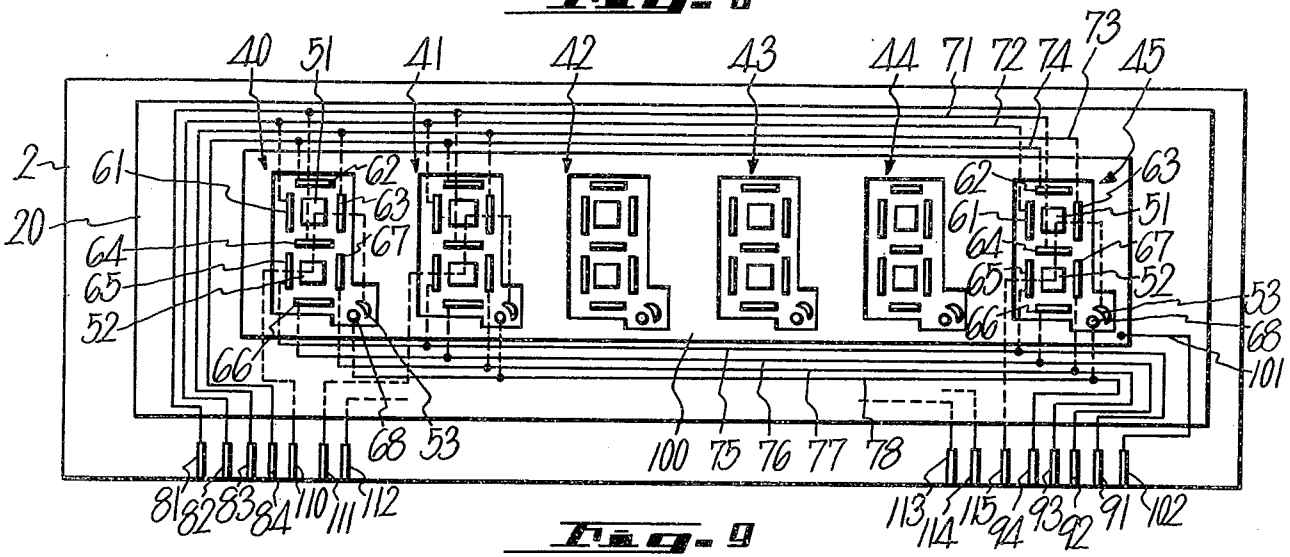
FIG. 8 is a plan view of the backing plate of FIG. 7 with a plurality of indicating units and selecting leads formed over the insulating layer.

FIG. 8 illustrates the next step of the method of making the indicator unit and illustrates a plurality of indicating units 40 to 45 which are formed on the top of the insulating layer 20.

In the next step the plurality of indicator units 40 to 45 (the number depending upon the desired number) are formed on the insulating layer 20 and aligned with the windows through the layer 20 so that electrical contact will be made with the interconnecting leads. Each of the indicator units comprises electrically conducting anode segments 51, 52 and 53 as well as an associated plurality of cathode elements 61 to 68. At the same time, a plurality of selecting leads 71 to 78 are formed on the insulating layer 20 with the leads 71 to 74 extending along the top of the indicator units 40 to 45 as shown in FIG. 8 and the selecting leads 75 to 78 extending along the bottom of the indicator units 40 to 45 as shown in FIG. 8. The anode and cathode segments and selecting leads are formed by suitable thin film techniques and are formed so as to align with the windows 30*a* to 38*a* and 30*b* to 38*b* so that electrical connections will be made between the selecting leads 71 to 78 and the anode and cathode segments.

A plurality of external leads 81 to 84 are formed on the insulating plate 2 adjacent the lower edge relative to FIG. 8 and are respectively connected to the selecting leads 71 to 74. A plurality of external leads 91 to 94 are respectively connected to the selecting leads 75 to 78 and are formed on the insulating plate 2 along the bottom edge as shown in FIG. 8.

It is to be realized that the indicator units 40 to 45, the selecting leads 71 to 78 and the external leads 81 to 84 and 91 to 94 are formed at the same time by a silk screen process and when the indicator units 40 to 45 and selecting leads 71 to 78 are printed on the insulating layer 20, each of the elements 61 to 68 and 51 to 53 are respectively connected to the associated selecting leads through the windows 30*a* to 38*d* formed in the insulating layer 20. For example, the cathode element 62 is formed so that it aligns with window 31*b* which connects it to one end of the interconnecting lead 11 and the selecting lead 74 is formed over the window 31*a* so that the selecting lead 74 is connected to the cathode segment 62 through the interconnecting lead 11. Simultaneously, all of the corresponding cathode segments 62 of all of the indicator units 40 to 45 are connected to lead 74 through associated windows and thus all of the segments 62 of all of the indicator units are electrically connected together and to the external lead 84. Similarly, all of the cathode segments 61 are connected by interconnecting lead 10 to selecting lead 72 and to external lead 82. All of the cathode segments 63 are connected by interconnecting leads 13 to selecting lead 73 which is connected to external lead 83. Each of the cathode segments 64 is connected by interconnecting lead 12 to selecting lead 71 which is connected to external lead 81. Each of the cathode segments 65 is connected by interconnecting lead 15 to selecting lead 75 and to external lead 91. Each of the cathode segments 66 is connected by interconnecting lead 16 to selecting lead 76 which is connected to external lead 92. Each of the cathode segments 67 is connected by interconnecting lead 17 to selecting lead 77 which is connected to external lead 93. Each of the cathode segments 68 is connected by interconnecting lead 18 to selecting lead 78 which is connected to the external lead 94.

Thus, in the structure defined thus far, the associated cathode segments of all of the indicator units 40 to 45 are electrically connected together and thus can be electrically energized by the eight cathode selecting leads 81 to 84 and 91 to 94. The three anode segments 51, 52 and 53 of each of the indicator units 40 to 45 are interconnected together by the interconnecting lead 14 and a separate external lead is formed along the lower edge of the insulating plate 2 so that the anode segments of each of the indicator units can be individually energized. For example, an external lead 110 is connected to interconnecting lead 14 of the indicator unit 40 which is connected to the anode segments 51, 52 and 53 of the indicator unit 40 and the indicator unit 40 will be energized when the external lead 110 is energized with a selective pattern of the cathode segments.

Likewise, the anode segments of the indicator unit 41 are connected through an interconnecting lead to the external anode lead 111 for the indicator unit 41. An external lead 112 is connected to the associated anode segments of the indicator unit 42 in a similar manner. An external lead 113 is connected to the anode segments of the indicator unit 43 and an external lead 114 is connected to the anode segments of the indicator unit 44. An external lead 115 is connected to the anode segments of the indicator unit 45.

The indicator display tube of the present invention is adapted to prevent an incorrect message display which is caused by accidental discharge of the indicator units. For this purpose in the illustrated example an auxiliary electrode or barrier electrode designated at 100 is utilized. The barrier electrode 100 may be formed around the indicator units 40 to 45 on the insulating layer 20 at the same time as the indicator units and leads and has suitable windows for the indicator units as shown. A lead 101 is also formed on the insulating layer 20 and extends from the barrier electrode 100 to an external lead 102 so that a suitable voltage may be applied. The leads 101 and 102 are formed at the same time that the barrier electrode 100 is formed. The leads, cathode and anode segments and barrier electrode are all formed of silver paste which adheres well to the glass insulating layer 20.

Figure 9:
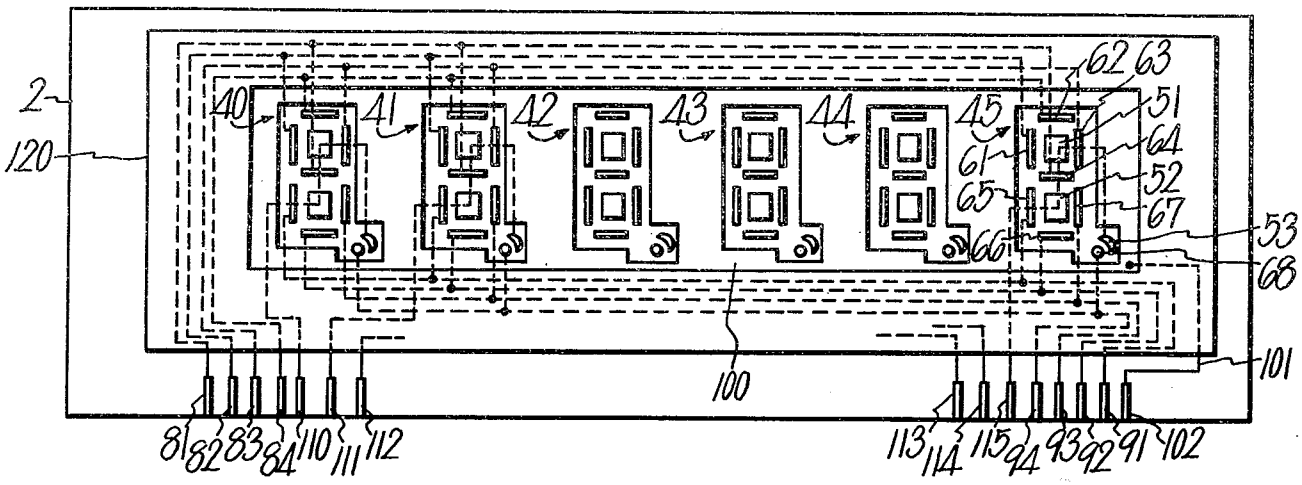
FIG. 9 is a plan view of the backing plate of FIG. 8 with an insulating layer formed thereon.

In the next step, as shown in FIG. 9, a second insulating layer 120 of glass is deposited over the selecting leads 71 to 78 and 101 but the indicator units are left uncovered by this second insulating layer 120. In other words, the cathode segments 61 to 68 and the anode segments 51 to 53 of each of the indicator units are left uncovered by the second insulating layer 120. The external leads are also left uncovered by the second insulating layer 120.

Since the cathode segments of each indicator unit are bombarded by ionized ions emitted from the space discharge layer which can cause them to sputter, it is necessary to form the cathode segments of a metal which resists sputtering and which has a low work function.

For accomplishing this, a thin nickel layer is formed on the plurality of indicator units 40 to 45 and over the barrier electrode 100 by electroplating in a plating bath as described below.

For nickel plating, a neutral plating bath is employed and the thickness of a plated layer is selected so that deposition of the nickel layer on the silver paste is enhanced. The preferred composition of the plating bath and the plating conditions are as follows:

Composition of Plating Bath

| | |
|---|---|
| Nickel sulfate | 240g/l |
| Nickel chloride | 45g/l |
| Boric acid | 25g/l |
| Nickel carbonate | 5g/l |
| Nickel hydroxide | 5g/l |

Plating Conditions

| | |
|---|---|
| PH = 5 | |
| Bath temperature | 40 to 50°C. |
| Plating time | 1 to 1.5 minutes |
| Current density | 30 to 40 mA/cm² |

These conditions cause the nickel layer to be deposited 5 to 10 microns thick on the silver paste layer.

Figure 10:
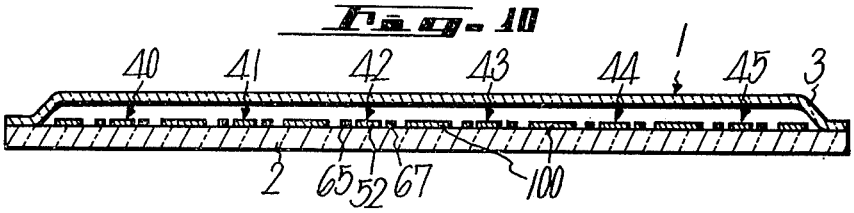
FIG. 10 is a sectional view taken on line X—X of FIG. 1.

After the indicator units are formed on the base plate 2, the cover plate 3 is attached to the base plate 2 as shown in FIG. 10 by suitable cement or other means so as to form a sealed chamber between the base plate 2 and cover plate 3 which encloses the indicator units. The external leads have portions which extend beyond the cover plate 3 on the base plate 2 so that electrical connection can be made.

The base plate 2 is formed with an opening to which an exhaust tube (not shown) may be connected so as to evacuate the space between the cover plate 3 and the base plate 2 and a suitable ionizing gas may be inserted into the space between the cover plate 3 and the base plate 2 and the opening sealed by a suitable seal in a conventional manner.

Figure 11:
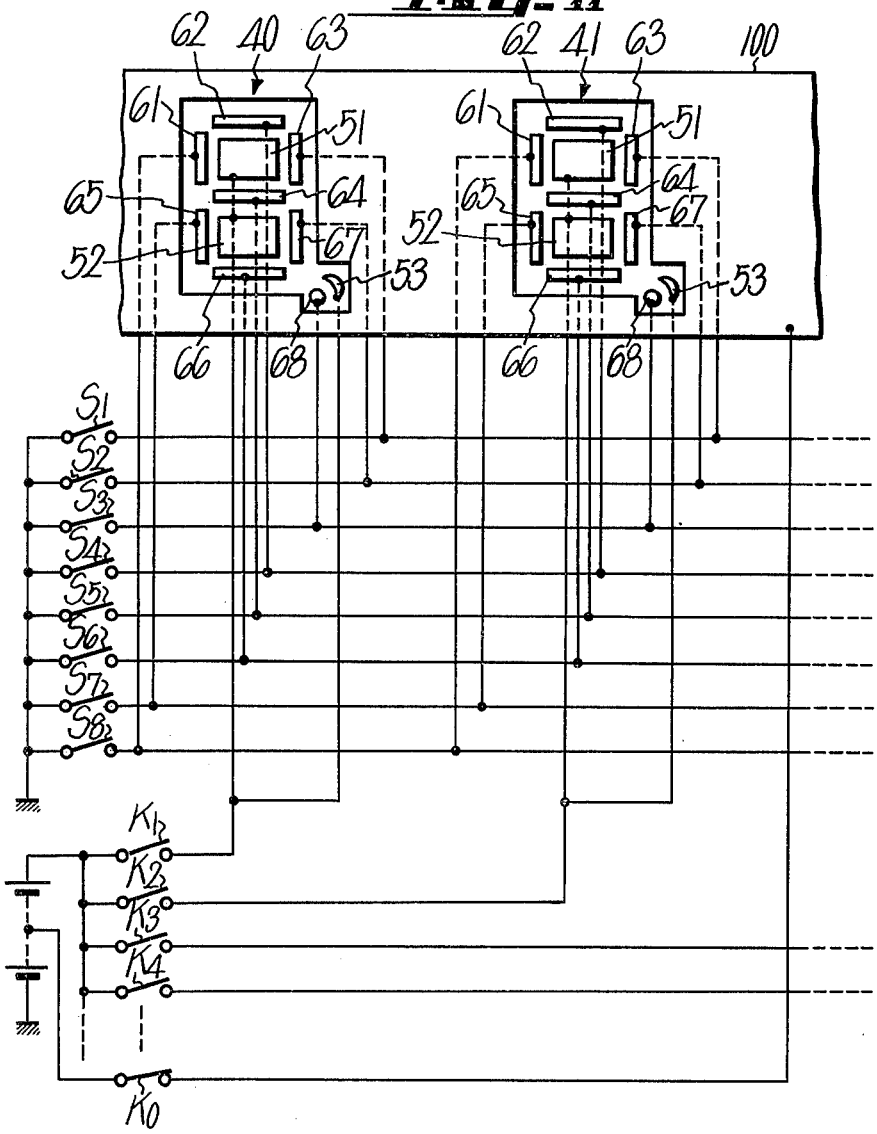
FIG. 11 is a circuit diagram showing the indicator assembly of FIG. 1 together with a drive circuit therefor.

FIG. 11 schematically shows the indicator tube assembly of FIG. 10 with a driving circuit. The indicator display tube of this invention operates as follows:

Assume that the number "1.8" is to be displayed. Switches S1, S2 and S3 are closed to ground the cathode segments 63, 67, and 68 and an anode voltage supply switch K1 is closed to supply an anode voltage to the anode segments 51, 52 and 52 of the indicator unit 40 causing the cathode segments 63, 67 and 68 to glow to display "1.".

Then, the switches S1, S2, S3 and K1 are opened and a switch K2 to the anodes of indicator 41 is closed together with switches S1, S2 and S4 to S8 to cause the cathode segments 61 to 67 of the indicator unit 41 to glow so that indicator 41 displays "8". Thereafter, "1."and "8" are alternately displayed by the indicator units 40 and 41. The switching speeds can be increased until the "1." and "8" appear to an observer to be simultaneously displayed. Electronic matrix switching means for sequentially closing switches as above are well-known and will not be described.

Conventional indicator tubes which do not have a barrier electrode as employed in the present invention can give an incorrect message display because as the glow discharge is repeated for predetermined periods of time the inert gas, such as for example, neon or argon which is sealed in the envelope, will be ionized and the ions will diffuse through the envelope and lower the discharge initiating voltage between and cathode segments of indicator units which should not glow. Thus when the indicator unit 40 displays "1.", the cathode segments 63, 67 and 68 of the remaining indicator units 41 to 46 are all grounded together as well as those of unit 40 and even if no anode voltage is supplied to the anode segments of the units 41 to 45, glow discharge will be produced between the anode segments 51 to 53 of unit 40 and the cathode segments 63, 67 and 68 of the other units and produce an erroneous display such as "1.1.1.".

In the present invention, the barrier electrode 100 is formed so that it surrounds the indicator units 40 to 45 and is supplied, through a switch KO, with a positive voltage which is lower than a voltage supporting discharge between the anode and cathode segments and which does not exceed the discharge initiating voltage between the electrode 100 and the anode and cathode segments. For example, when a positive voltage of 175V is impressed on the anode segments 51 to 53 of the indicator unit 40, the barrier electrode 100 is supplied with a positive voltage of about 100V. Thus, positive ions produced in the vicinity of the indicator unit 40 are repelled by the positive voltage fed to the barrier electrode 100 toward the inner wall of the cover plate 3 and electrons are attracted by the barrier electrode 100 and the anode segments 51 and 53 which are being energized. Thus, ions are prevented from diffusing or spreading in the envelope and hence do not cause neighboring indicator units to glow. That is, the provision of the barrier electrode effectively avoids the possibility of an incorrect display from resulting because of the diffusion of ionized ions.

In the foregoing example, the barrier electrode 100 is formed integrally over the entire area of the base plate 2 but the same effect can be obtained by forming separate barrier electrodes between adjacent indicator units.

Figure 12:
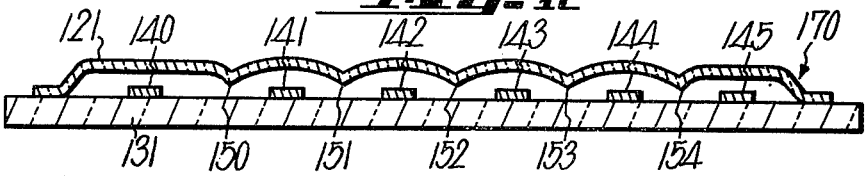
FIG. 12 is a fragmentary sectional view schematically illustrating a modified form of the indicator display tube of this invention.

FIG. 12 shows in cross section a modified form of the indicator display tube of this invention. In this example, the error preventing means comprise a cover plate 121 rather than the barrier electrode 100 mentioned above. The cover plate 121 is formed with projections 150 to 154 as shown and is mounted on base plate 131 in such a manner that each of the projections 150–154 lie between adjacent indicator units 140 to 145 formed on the base plate 131, as clearly shown in FIG. 12. With such an arrangement, when the indicator unit, for example, 140 is energized and glows, ions produced by glow discharge will tend to move towards the neighboring indicator unit 141 but are stopped by the projection 150 formed in the cover plate 121, thus preventing an erroneous message display as a result of accidental discharge between neighboring indicator units.

Figure 13:
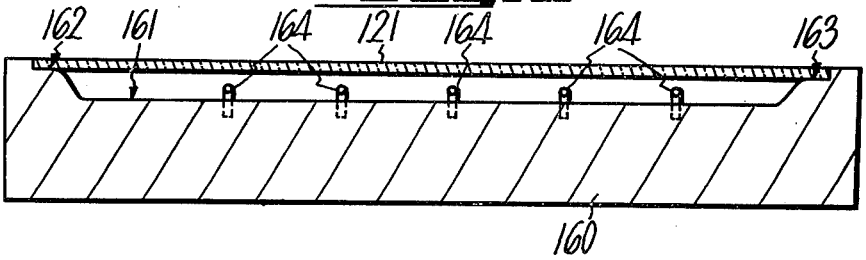
FIGS. 13 and 14 are sectional views showing the steps involved in the making of a cover of the tube depicted in FIG. 12.
Figure 14:
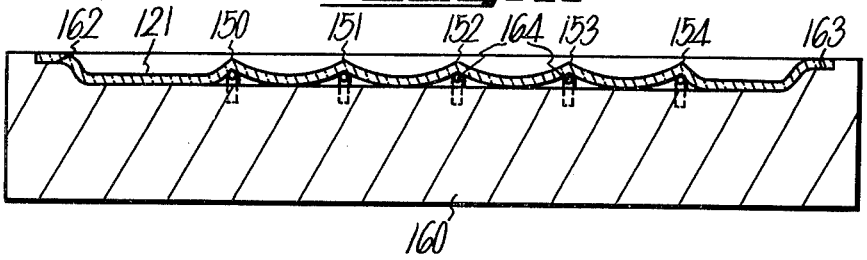

FIGS. 13 and 14 illustrate the manner in which the projections 150–154 of the cover plate 121 are formed. As shown in FIG. 13, a thin sheet of glass 121 is placed on a support 160 which is formed of a heat-resisting material, for example, carbon, and has a depression 161 and stepped portions 162 and 163 at both ends. In the depression 161 of the support 160 a plurality of support pieces 164 are mounted at regular intervals which correspond to the spacings of the indicator units 140 to 145. The support pieces 164 may be formed integrally with the support 160 or may be formed by embedding in the support 161 inverted U-shaped metal wires (which preferably is wire made of an Ni-Co-Fe alloy which has the same temperature coefficient of expansion as glass). The support pieces 164 are sprayed with carbon which serves as a mold releasing agent.

The cover plate 121 is placed on the support 160 with its edges resting on the stepped portions 162 and 163 which extend around its periphery. It is then heated to the range of 630°C. to 700°C. in an atmosphere of nitrogen gas in a furnace for about 20 minutes. The cover plate 121 softens and sags down into the depression 161. The cover plate 121 is prevented by the upwardly projecting support pieces 163 from sagging down where the pieces are located. The cover plate 121 conforms to the depression 161 but the projections 150–154 are formed over the support pieces 164 as shown in FIG. 14.

Then, the cover plate 121 in which the projections 150 to 154 have been formed is removed from the support 160 and is mounted on the base plate 131 to cover the indicator units formed thereon to obtain the structure shown in FIG. 12. The cover plate 121 is mounted on the base plate 131 so that each of the depressions formed in the cover plate 121 enclose corresponding indicator units. Then, the cover plate 121 and the base plate 131 are sealed by frit glass at their marginal portions to provide an indicator display tube 170 such as depicted in FIG. 12.

Further, an ionizing gas, for example, argon, neon or the like, is sealed in the tube 170 and, if necessary, a getter is activated in the tube to provide a finished tube.

This embodiment prevents undesired accidental discharges by using a cover plate of a particular shape which is easy to produce. Further, the tube is formed with only two glass plates, and hence can be simply produced.

Also by the use of this method, the envelope can be formed extremely thin as in the example of FIG. 1. Further, since the front portion of the indicator display tube is cylindrical at those areas covering the indicator units, a lens effect is obtained which facilitates interpretation of the messages being displayed.

Figure 15:
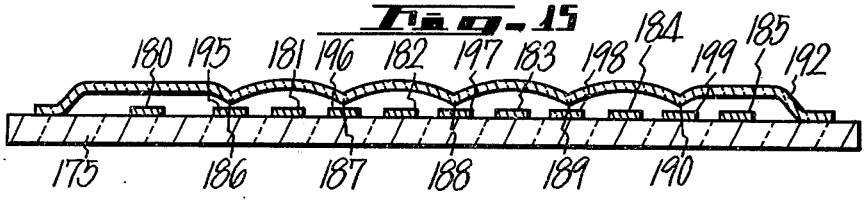
FIG. 15 is a sectional view schematically showing another modification of the indicator display tube of this invention.

FIG. 15 schematically shows in cross section another modified form of this invention. In this example indicator units 180 to 185 are formed on a glass base plate 175 and a cover plate 192 is corrugated as shown in FIGS. 13 and 14 to form projections 186 to 190 which lie between adjacent ones of the indicator units in the finished tube. Also, additional or barrier electrodes 195–199 to which are supplied a predetermined potential, are formed on base plate 175 between adjacent indicator units. Thus, it is seen that in this example undesired accidental discharge of the indicator units can be more effectively prevented by both the barrier electrodes 195 to 199 and the projections 186 to 190.

Figure 16:
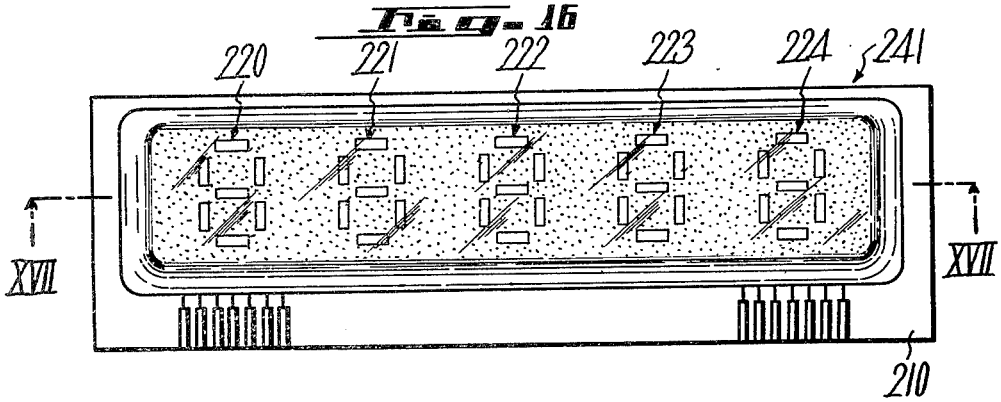
FIG. 16 is a plan view schematically illustrating another modification of the indicator display tube of this invention.
Figure 17:
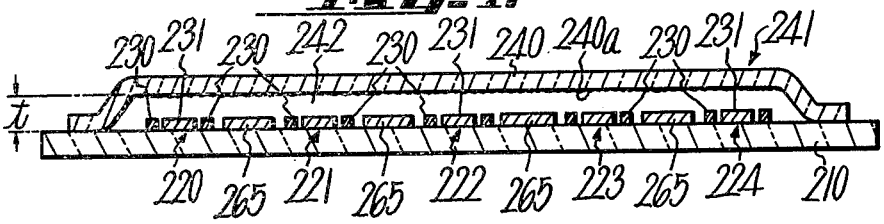
FIG. 17 is a sectional view taken on the line XVII—XVII in FIG. 16.

In FIGS. 16 and 17 there is illustrated another modification of this invention, in which indicator units 220 to 224 each consisting of a plurality of cathode segments 230 and anode segments 231 are formed on a glass base plate 210 in the same manner as in the foregoing examples. A transparent insulating cover plate 240 is mounted on the base plate 210 in a predetermined spaced relation to the indicator units 220 to 224 and the cover plate 240 and the base plate 210 are sealed at their opposing peripheral portions with a frit glass seal. The envelope designated generally as 241 is constructed such that the distance *t* between the flat base plate 210 and the cover plate 240 is uniform at any place in the envelope.

Figure 18:
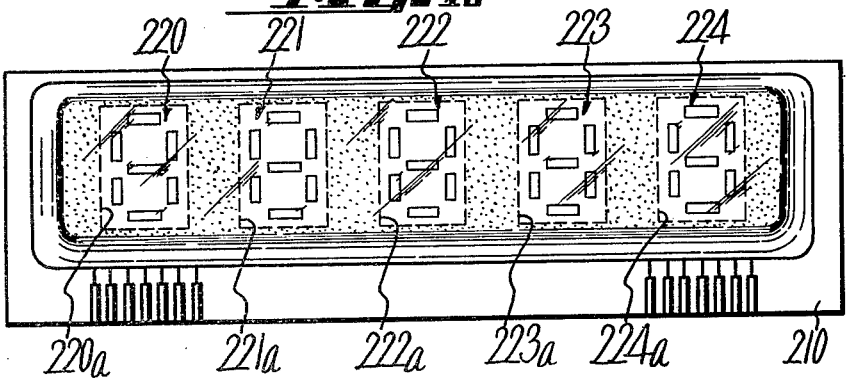
FIGS. 18 and 19 are a plan view and a sectional view schematically illustrating other modifications of this invention.

Also, the inner surface 240*a* of the cover plate 240 is roughened to provide an area on which the recombination of ionized ions occures. The entire area of the inner surface of the cover plate 240 may be roughened as shown in FIG. 16 and the indicator units show through. In FIG. 18 the inner surface of the cover plate 240 is roughened until it is opaque except at those areas covering indicator units 220 to 240.

The inner surface of the cover plate 240 can be easily roughened by means of sandblasting or by rinsing the cover plate with fluoric acid, such as by soaking the cover plate in a 5% dilute solution of fluoric acid for about 5 to 20 seconds.

The roughened inner surface of the cover plate 240 substantially increases the recombination area of the ionized ions so that the ionized ions produced by glow discharge of a selected one of the indicator units nearly all recombine and are thus prevented from moving toward neighboring indicator units, thus ensuring avoidance of an incorrect message display.

Figure 19:
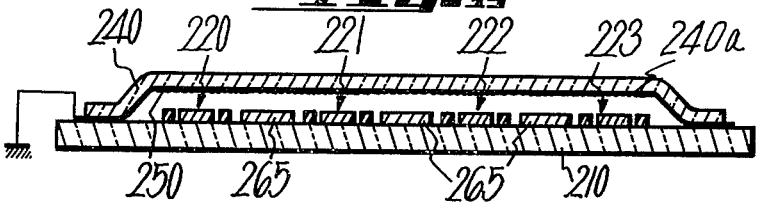

In the above example the inner surface of the cover plate 240 is roughened to prevent undesired discharge between the indicator units. It is also possible as shown in FIG. 19 to deposit over the roughened inner surface 240*a* of the cover plate 240 a transparent conductive layer (a nesa electrode) 250 and apply a suitable potential such as ground to layer 250. In this case, the transparent conductive layer may also be deposited by evaporation on those areas of the roughened surface corresponding to the spaces between adjacent indicator units.

Thus, charge stored on the inside of the envelope will be grounded through the transparent conductive layer 250 to further ensure the elimination of erroneous message displays.

In addition, erroneous message displays due to neighboring indicator units can be prevented more effectively by providing a barrier electrode 265 between adjacent indicator units as depicted in FIGS. 16 and 19.

The anode and cathode segments of the indicator display tube of this invention are formed by plating nickel on silver paste coated on the glass base plate because silver paste has a low firing temperature and adhere well to the glass base plate. In general, however, silver sputters easily in an atmosphere of a neon, argon or like gas within a discharge tube and for this reason nickel which does not sputter easily is plated on the silver paste to prevent sputtering.

Figure 20:
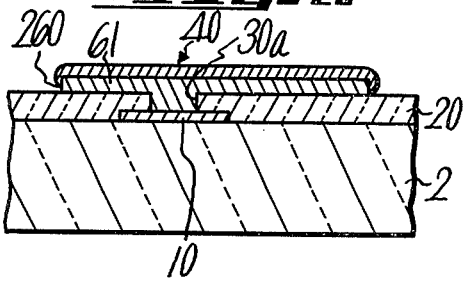
FIG. 20 is an enlarged fragmentary sectional view of the backing plate of FIG. 9.

FIG. 20 is an enlarged fragmentary cross-sectional view of the indicator unit shown in FIG. 9. It can be noted in this figure that nickel has not been deposited in sufficient thickness on the edges 260 of the silver paste layer 61 and there is the possibility that the silver will sputter and cause an incorrect message display or shorten the service life of the indicator display tube.

Figure 21:
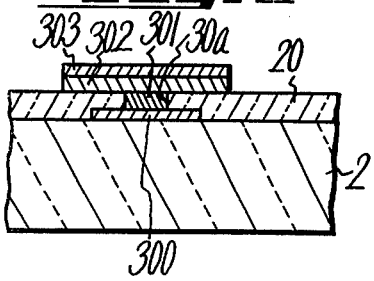
FIGS. 21 to 23 are sectional views, similar to FIG. 20, showing other modified forms of this invention.

FIG. 21 schematically illustrates in section one portion of an improved indicator unit which avoids the defect caused by the edges of the silver paste not being covered. In the illustrated example an interconnecting lead 300 connected to a selecting lead is formed of silver paste on the glass base 2 and an insulating glass layer 20 of a low melting point is formed on the base plate 2 over the interconnecting lead 300. A window 30*a* is formed in the glass layer 20 at a location corresponding to one portion of the interconnecting lead 300.

Then, nickel is electro-plated in the window 30*a* of the glass layer 20 to form a nickel plated layer 301 therein.

Then a nickel layer 302 about one micron thick is formed by non-electrolytic plating over the entire area of the insulating glass layer 20 including the nickel plated layer 301 and then a nickel layer 303 about 5 to 10 microns in thickness is formed by electroplating over the nickel layer 302.

Then an etching mask layer (not shown) of the same pattern as that of the electrodes to be ultimately formed is deposited on the uppermost nickel layer 303 and the nickel layers 302 and 303 are selectively etched away through the etching mask layer. Thereafter, the etching mask layer is removed. In this manner, electrode segments of a desired pattern are formed on nickel on the glass layer 20 to provide a desired indicator unit.

Thus, the cathode and anode segments are all formed of nickel, and hence will resist sputtering and will withstand long usage. Also, the lead 300 connected to the electrode segment is formed of silver paste which adheres well to the glass base plate 2 and the mechanical bonding of the electrodes is excellent.

Figure 22:
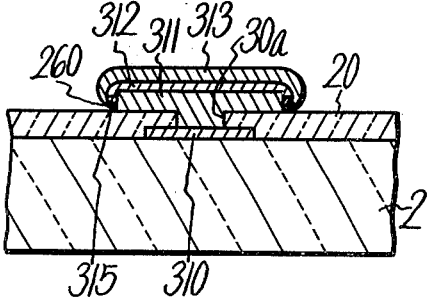

FIG. 22 illustrates another modification of this invention in which an interconnecting lead 310 is formed of silver paste on the glass base plate 2 and an insulating glass layer 20 is formed on the interconnecting lead 310 with one portion of the latter left uncovered to form a window 30*a*. Then, silver paste of the same pattern as an electrode to be ultimately formed is printed by printing techniques on the glass layer 20 including the window 30*a* and is baked to form a substructure layer 311 constituting one portion of the electrode segment. The layer 311 and the interconnecting lead 310 are both formed of the same silver paste and they will be firmly joined together mechanically through the window 30*a* in the glass layer 20.

Thereafter, the layer 311 is plated with a copper layer 312, which is then plated with a nickel layer 313. The entire structure is heated to a range of about 350° to 430°C. in an oxidizing atmosphere to oxidize the edge portion 260 of the copper layer 312 to which the nickel plated layer 313 has difficulty in adhering and a copper oxide layer 315 such as $Cu_2O$, CuO will be formed to form the desired electrode.

With such an arrangement, the upper surfaces of the silver paste layer constituting the cathode or anode segment are covered by the nickel layer 313 over the copper layer 312 and the peripheral edge portion 260 is covered by the copper oxide layer 315, so that sputtering of the silver paste will be completely prevented.

Figure 23:
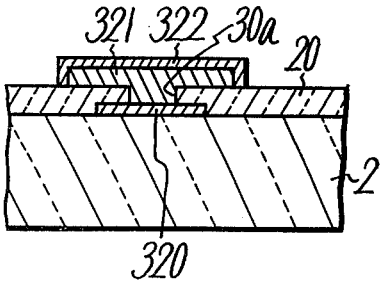

FIG. 23 shows a further modification of the invention in which an interconnecting lead 320 is formed of silver paste on the glass base plate 2 and an insulating glass layer 20 is formed over the base 2 and has a window 30*a* to expose one portion of the interconnecting lead 320. Then, a platinum paste layer 321 of a predetermined pattern is printed by printing techniques on the insulating glass layer 20 and over the window 30*a* and the entire structure is baked. A nickel layer 322 is then plated onto the platinum paste layer 321 to provide desired cathode and anode segments.

The platinum paste has a baking temperature of about 560°C. and adheres well to glass.

With the above arrangement, the sub-structures of the cathode and anode segments are formed of platinum which does not sputter and the electrode segments will have long life.

Furthermore, in order to prevent oxidation of the surface of anode segments, a precious metal, for example, platinum or gold, may be used for anode segments. For this purpose the cathode segments may be formed by plating nickel on silver paste as described above.

As described above, the provision of a barrier means prevents incorrect message displays and a suitable selection of the material of the electrode segments provides an indicator display tube which has long service life.

The indicator tube of this invention provides an improved method of producing an indicator tube wherein a plurality of indicating leads are initially formed on the insulating plate 2 and each of the elements of the indicator unit is formed so as to connect through an insulating layer to the interconnecting leads. For example, the cathode element 62 is directly connected to the interconnecting lead 11 through the hole 31*b* in the insulating layer 20 and it is therefore free from undesired discharges which would result in incorrect indications on the indicator tube.

In prior art devices mis-discharges and incorrect indications occur because the elements of the cathode have an external lead which is connected to a selecting lead which is not covered by an insulating layer as in the present invention. Thus, when a voltage is applied to the desired cathode segment an electrical discharge will occur not only between the desired cathode segment and its associated anode but it may also occur between the anode and a lead which passes to one of the other cathode segments. Such discharge is undesirable and causes a mis-discharge or inaccurate indication to the operator. The insulating layers 20 and 110 prevent this in that the interconnecting leads in the present indicator tube are covered by an insulating layer which eliminates such undesired discharges.

It will be apparent that many modifications and variations may be effected without departing from the scope of the novel concepts of this invention.

We claim as our invention:

1. An indicator display tube comprising:

a plurality of indicator units formed on a plate of an insulating material, each of said plurality of indicator units consisting of a plurality of first electrode segments and at least one second electrode corresponding to said first electrode segments;

a transparent cover to form an envelope with said indicator units enclosed therein;

an ionizable gas sealed in said envelope; and barrier means formed on the inner surface of said cover for preventing scattering of ionized ions when said gas is ionized and to prevent erroneous displays by said indicator units wherein said barrier means comprises a roughened surface formed on the inner surface of said cover.

2. An indicator display tube according to claim 1 wherein an electrically conducting layer is attached to said roughened surface.

3. An indicator display tube according to claim 1 wherein said roughened surface is formed on the inner wall of said cover between adjacent indicator units.

4. An indicator display tube comprising:

an envelope including a transparent cover and a plate of insulating material;

a plurality of indicator units sealed in said envelope, each of said plurality of indicator units comprising a plurality of first electrode segments formed on said plate and at least one second electrode corresponding to said first electrode segments, and ionized gas in said envelope;

a plurality of first leads each connected to corresponding ones of said first electrode segments of said indicator units;

a plurality of second leads each connected to said second electrode of each of said indicator units;

barrier electrode plate means in said envelope disposed between each of said indicator units; and physical barrier means formed on the inner surface of said cover for preventing scattering of ionized ions when said gas is ionized and to prevent erroneous display by said indicator units, wherein said physical barrier means comprises a roughened surface formed on the inner surface of said cover.

5. An indicator display tube according to claim 4 in which a transparent conductive layer is disposed on said roughened surface and is electrically grounded.

6. An indicator display tube according to claim 4 wherein said roughened surface is formed on the inner wall of said cover between adjacent indicator units.

* * * * *